US005797304A

United States Patent [19]

Sterr et al.

[11] Patent Number: 5,797,304

[45] Date of Patent: Aug. 25, 1998

[54] DIE CUT CONFETTI AND A METHOD OF MANUFACTURING

[75] Inventors: Ardina K. Sterr, Sherman Oaks; S. Clark Bason, North Hollywood, both of Calif.

[73] Assignee: Artistry In Motion Entertainment, Inc., Van Nuys, Calif.

[21] Appl. No.: 658,834

[22] Filed: May 31, 1996

Related U.S. Application Data

[63] Continuation-in-part of Ser. No. 639,249, Apr. 23, 1996, Ser. No. 53,517, Apr. 23, 1996, Ser. No. 53,622, Apr. 23, 1996, and Ser. No. 53,516, Apr. 23, 1996.

[51] Int. Cl.[6] ..... B26D 7/06

[52] U.S. Cl. ..... 83/27; 83/55

[58] Field of Search ..... 83/27, 55, 84, 83/86, 471.2, 481, 552; 30/278, 279.2, 314, 315, 358, 364; 446/475, 491

[56] References Cited

U.S. PATENT DOCUMENTS

| | | | |
|---|---|---|---|
| D. 385,824 | 11/1997 | Sterr et al. . | |
| 825,843 | 7/1906 | Kliemandt . | |
| 1,084,636 | 1/1914 | Hunerkopf . | |
| 1,090,778 | 3/1914 | Clark . | |
| 1,122,421 | 12/1914 | Reddington . | |
| 1,491,809 | 4/1924 | Macchia . | |
| 1,663,679 | 3/1928 | Carpenter . | |
| 3,398,614 | 8/1968 | Cleary . | |
| 3,616,720 | 11/1971 | Larson . | |
| 3,677,117 | 7/1972 | Cutter . | |
| 3,826,170 | 7/1974 | Jones et al. . | |
| 4,043,234 | 8/1977 | Godin . | |
| 4,210,041 | 7/1980 | Mitman et al. . | |
| 4,613,321 | 9/1986 | Kesten et al. | 83/49 |
| 4,798,116 | 1/1989 | Silver et al. | 83/858 |
| 4,932,915 | 6/1990 | Boris . | |
| 5,199,745 | 4/1993 | Balsamo | 446/475 |
| 5,295,633 | 3/1994 | Kimbro et al. | 241/166 |
| 5,352,148 | 10/1994 | Watkins . | |
| 5,354,227 | 10/1994 | Watkins . | |
| 5,388,490 | 2/1995 | Buck . | |
| 5,403,225 | 4/1995 | Watkins . | |
| 5,419,731 | 5/1995 | Watkins . | |
| 5,487,706 | 1/1996 | Wilk | 472/54 |
| 5,495,671 | 3/1996 | Shun-Yi | 30/364 |
| 5,507,680 | 4/1996 | Watkins . | |
| 5,620,354 | 4/1997 | Watkins | 446/475 |
| 5,643,042 | 7/1997 | Watkins | 446/475 |

FOREIGN PATENT DOCUMENTS

| | | |
|---|---|---|
| 341784 | 1/1931 | United Kingdom . |

OTHER PUBLICATIONS

U.S. application No. 08/639,249, Sterr et al., filed Apr. 23, 1997.

U.S. application 29/0653622, Sterr et al., filed Apr. 23, 1997.

U.S. application 29/053517, Sterr et al., filed Apr. 23, 1977.

*Primary Examiner*—Maurina T. Rachuba

*Attorney, Agent, or Firm*—Lyon & Lyon LLP

[57] ABSTRACT

A method of manufacturing confetti includes stacking a plurality of sheets of lightweight material into a stack, placing an open ended gang die onto the stack, applying pressure to cut the stack into plurality of shaped stacks, and bursting each of the shaped stacks to separate the sheets from one another. The open ended gang die is formed by welding individual dies onto metal pull bars of a gang die.

20 Claims, 23 Drawing Sheets

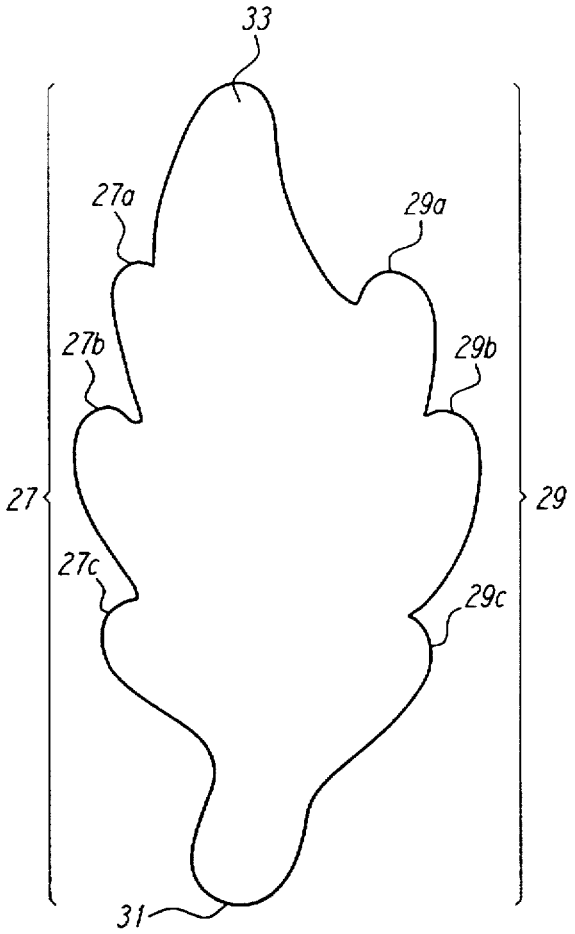
FIG. 11
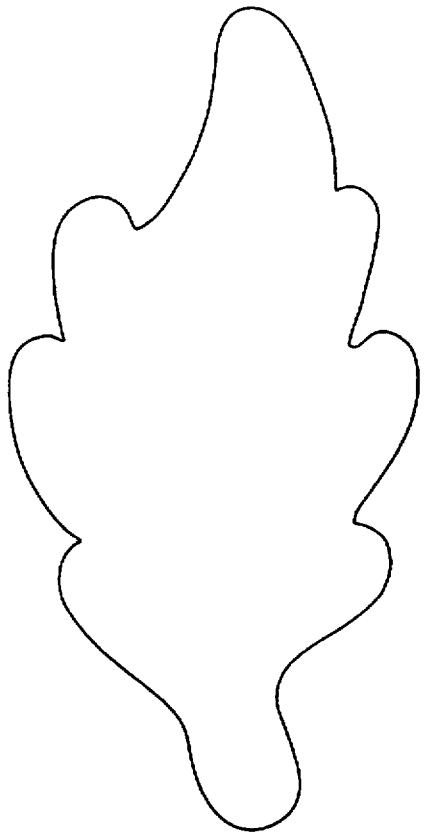
FIG. 12
FIG. 13

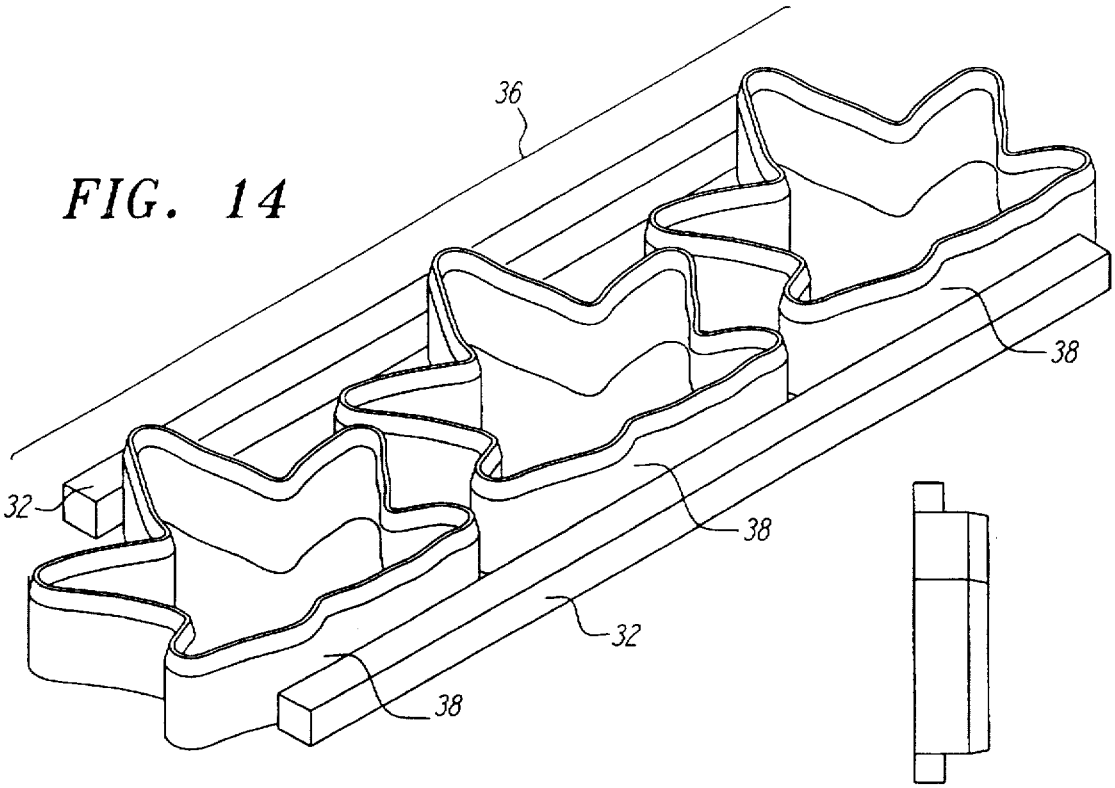
FIG. 14
FIG. 17
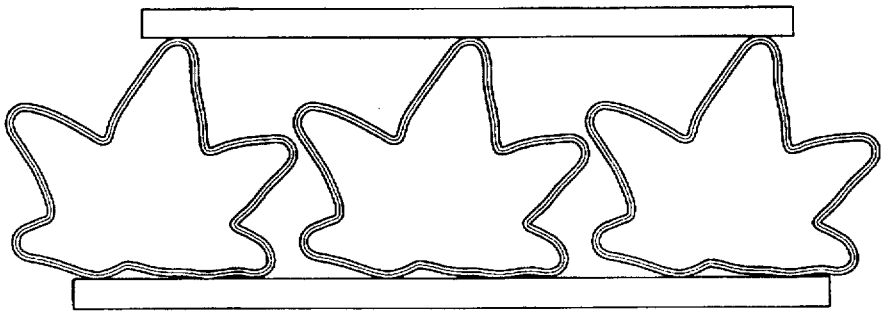
FIG. 15
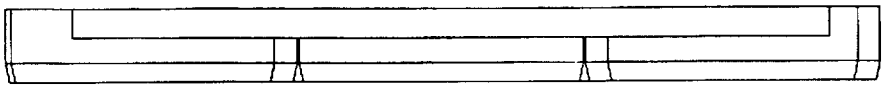
FIG. 16

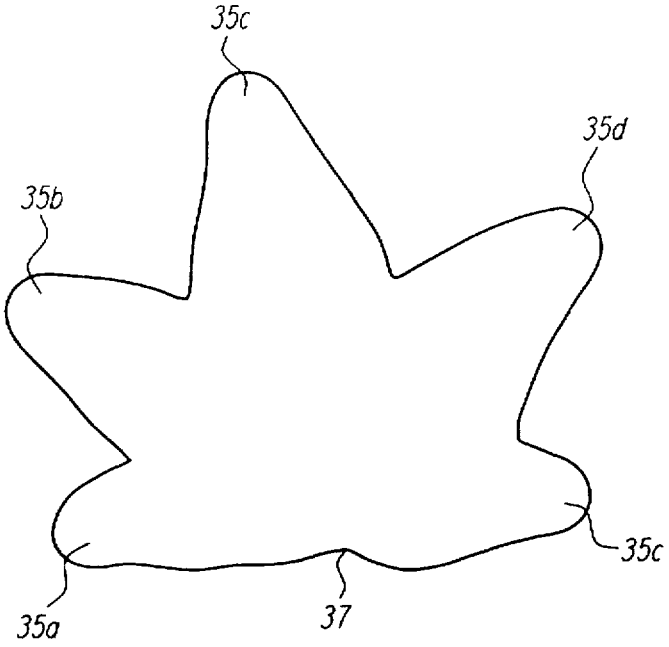
FIG. 21
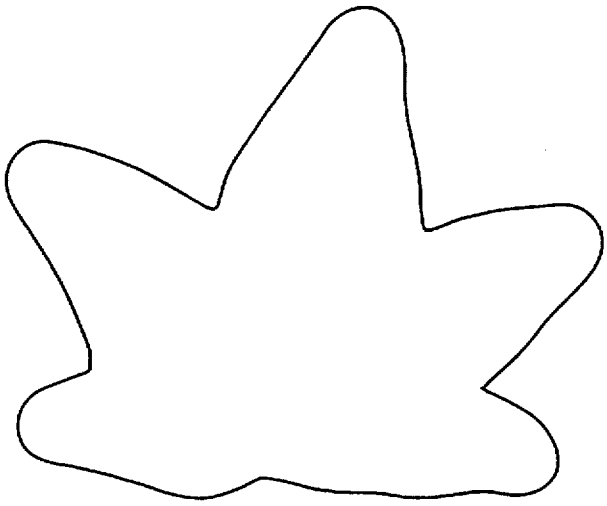
FIG. 22
FIG. 23

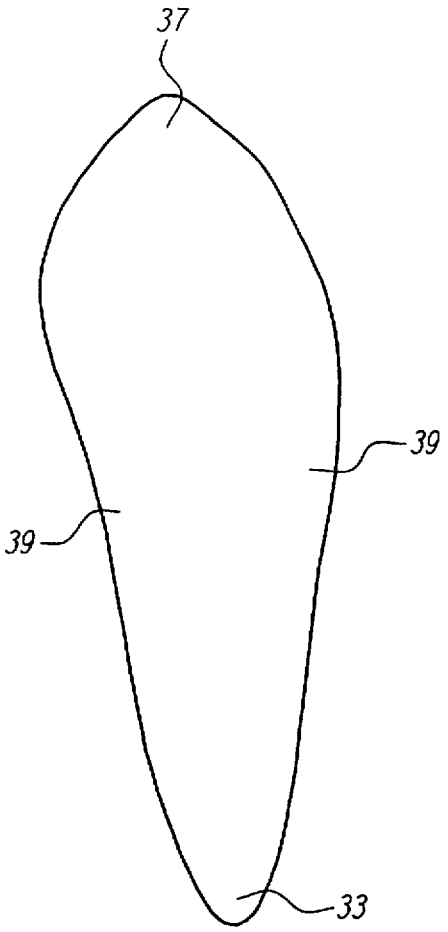
FIG. 31
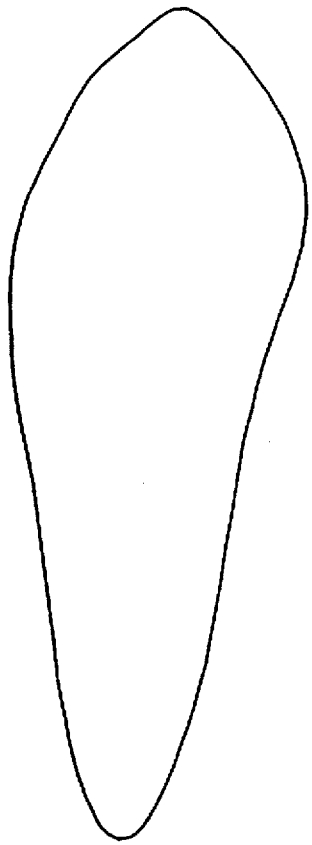
FIG. 32
FIG. 33

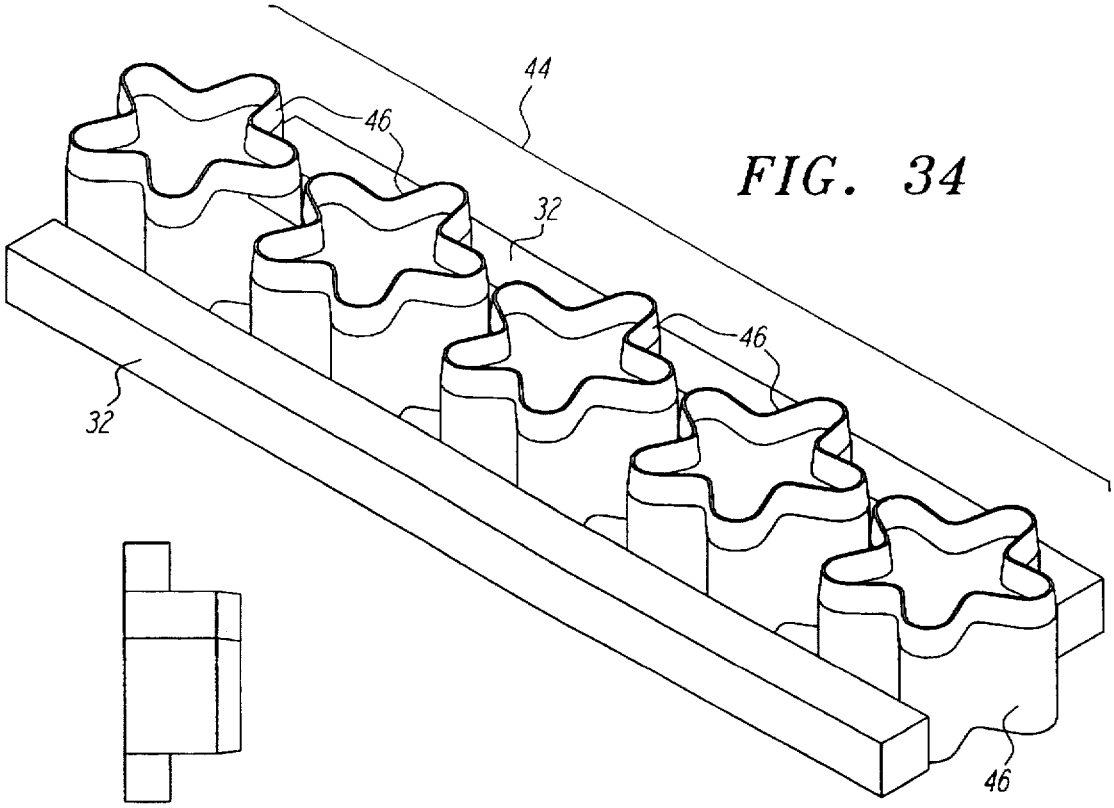
FIG. 34
FIG. 37
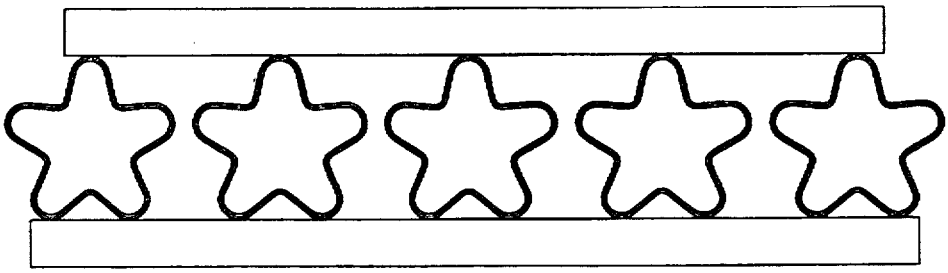
FIG. 35
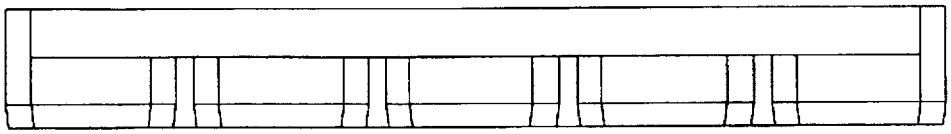
FIG. 36

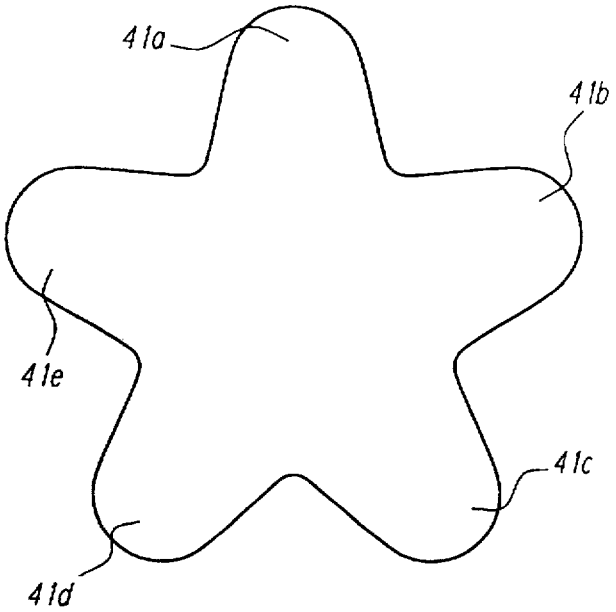
FIG. 41
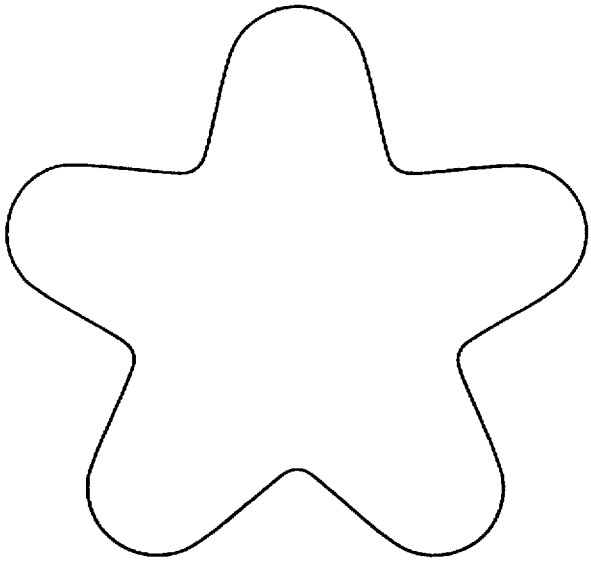
FIG. 42
FIG. 43

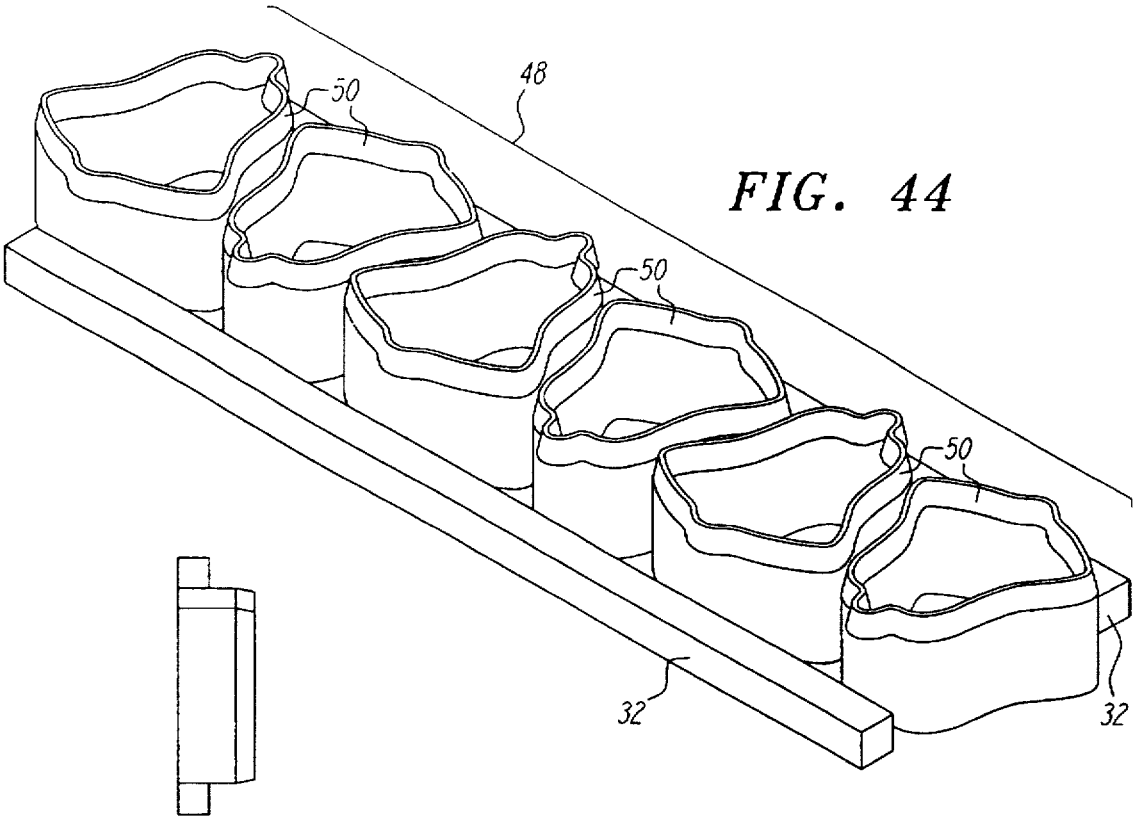
FIG. 44
FIG. 47
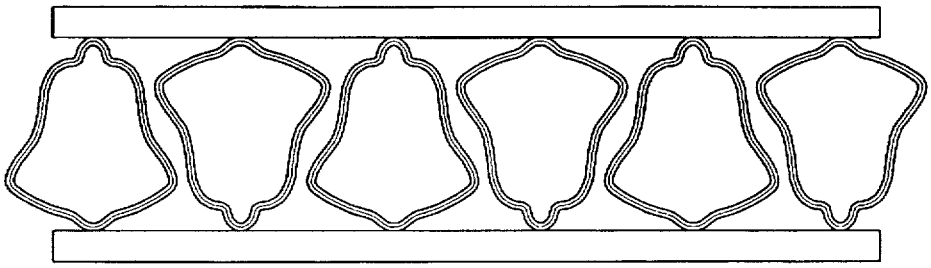
FIG. 45
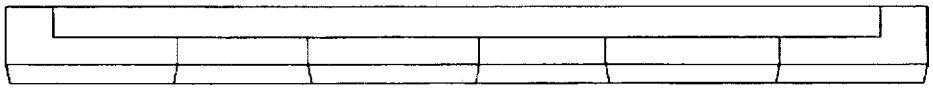
FIG. 46

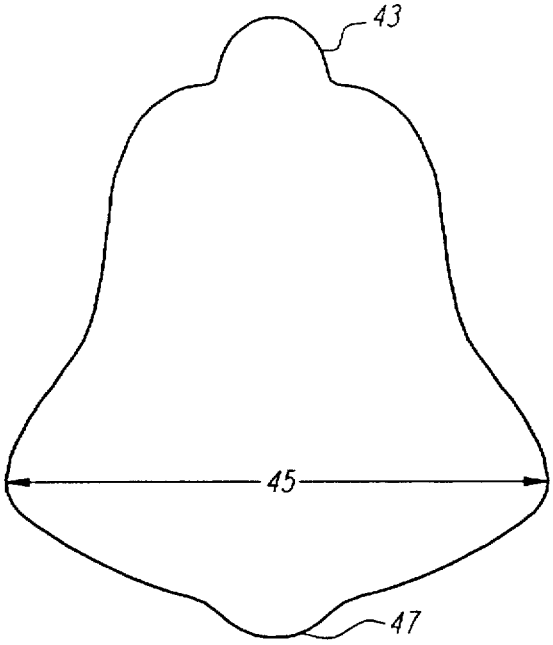
FIG. 51
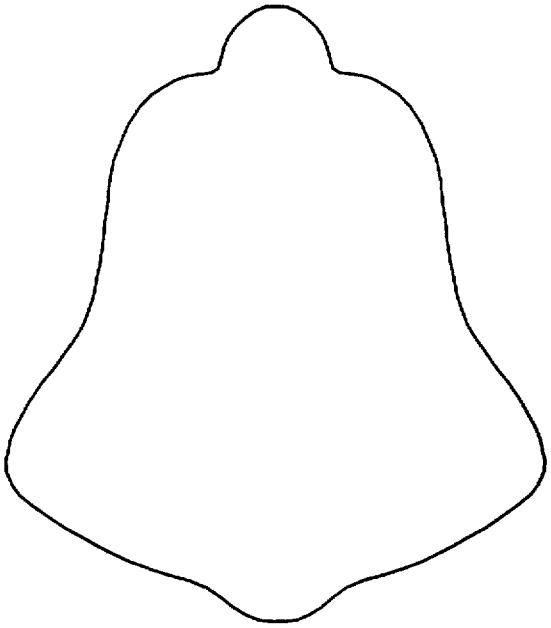
FIG. 52
FIG. 53

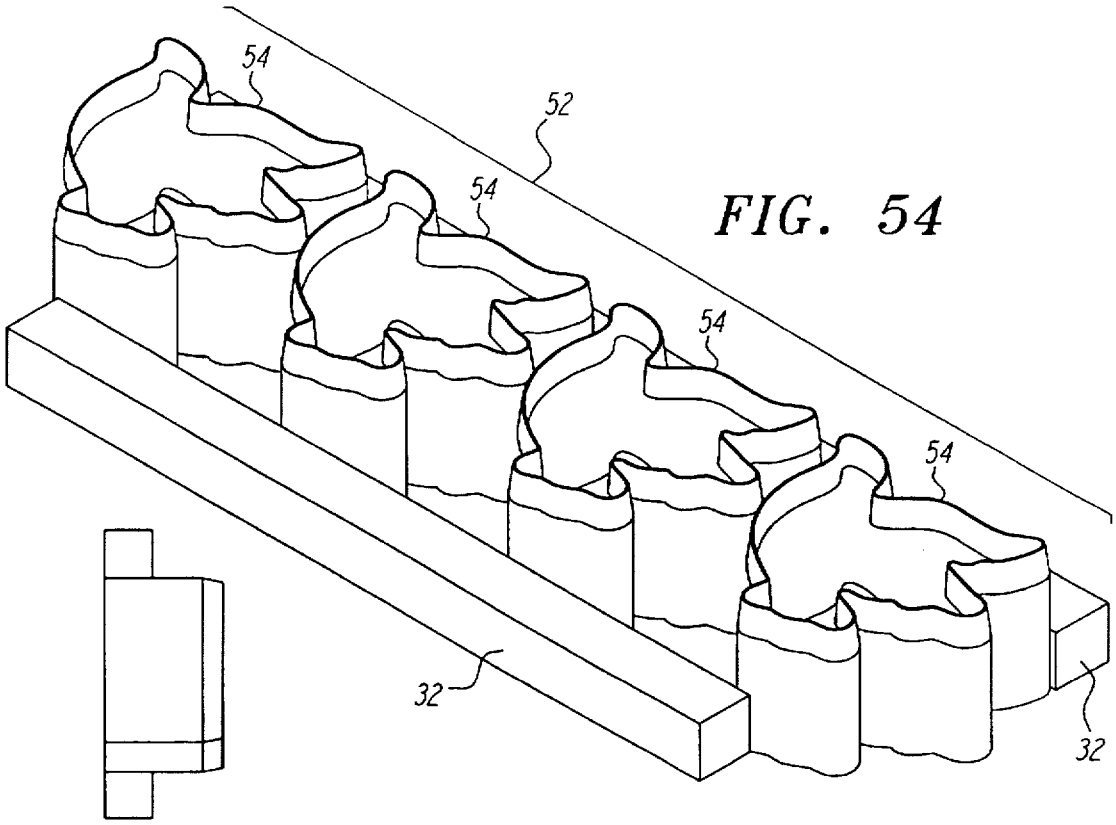
FIG. 54
FIG. 57
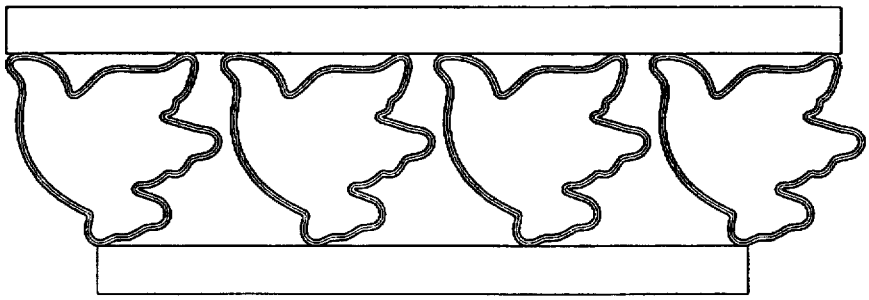
FIG. 55
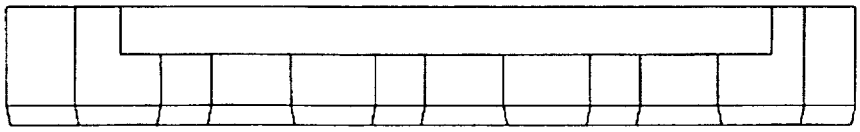
FIG. 56

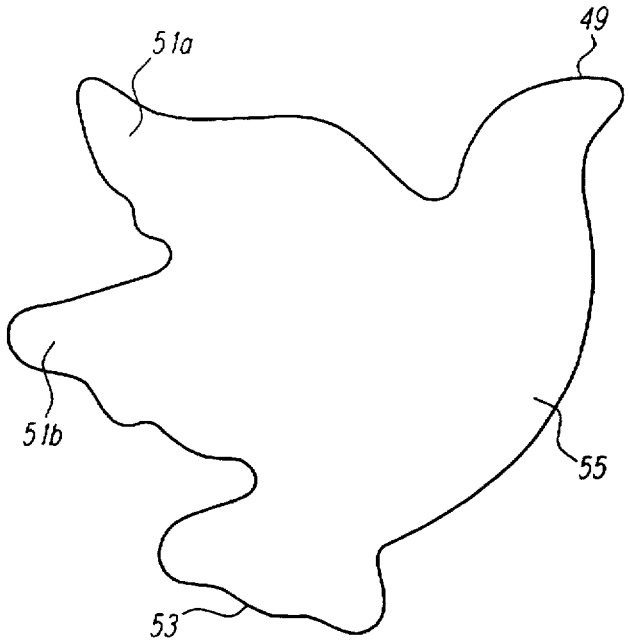
FIG. 61
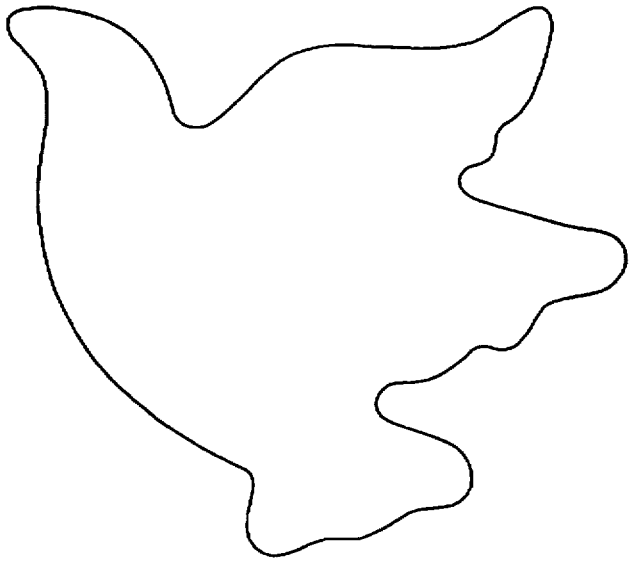
FIG. 62
FIG. 63

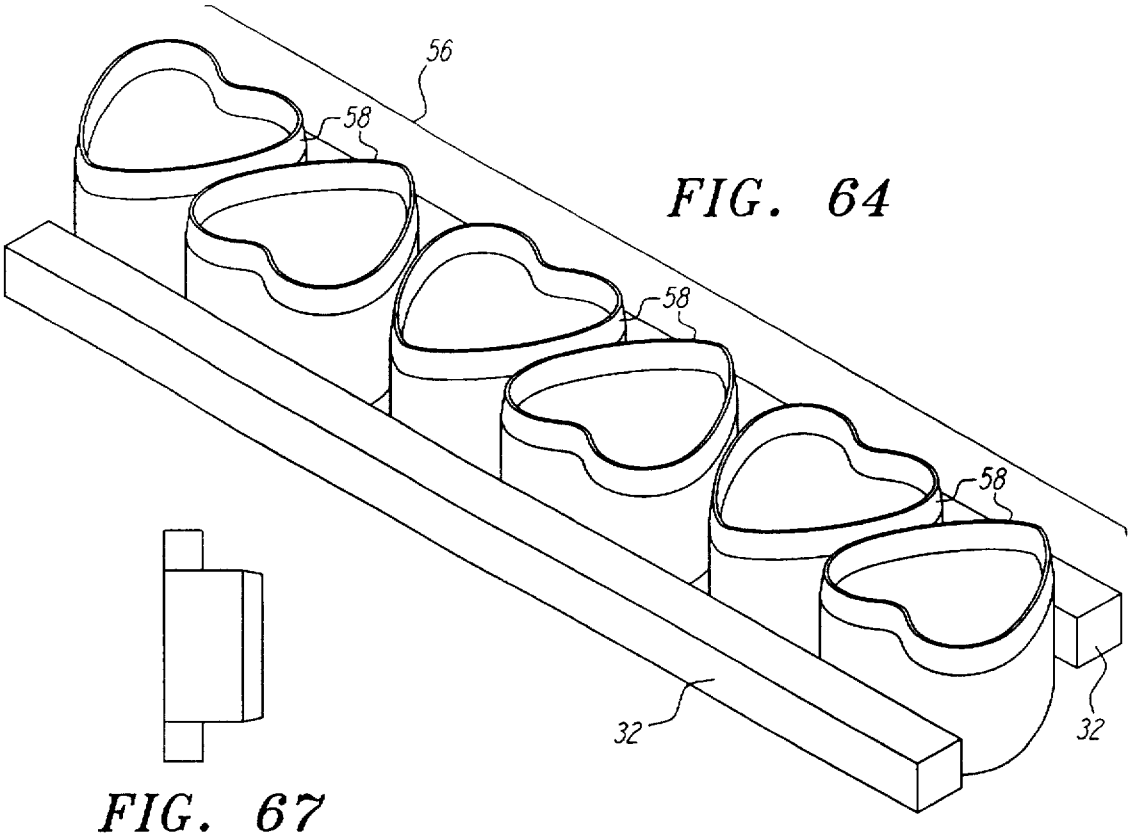
FIG. 64
FIG. 67
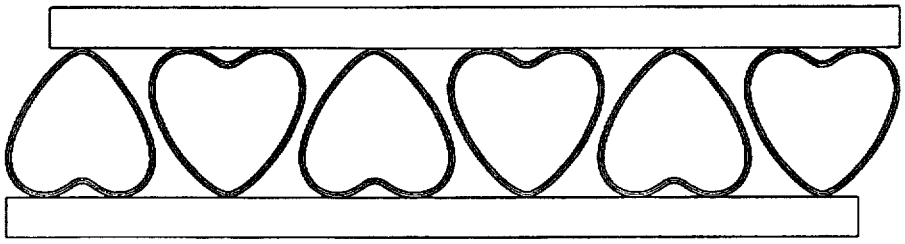
FIG. 65
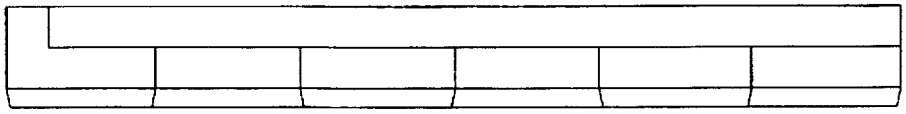
FIG. 66

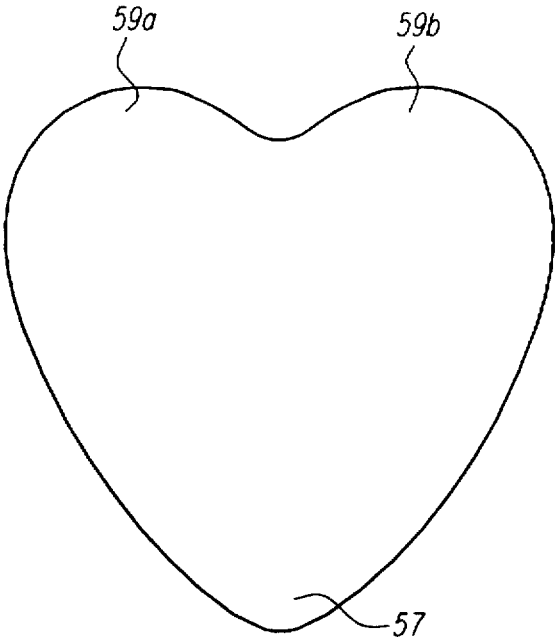
FIG. 71
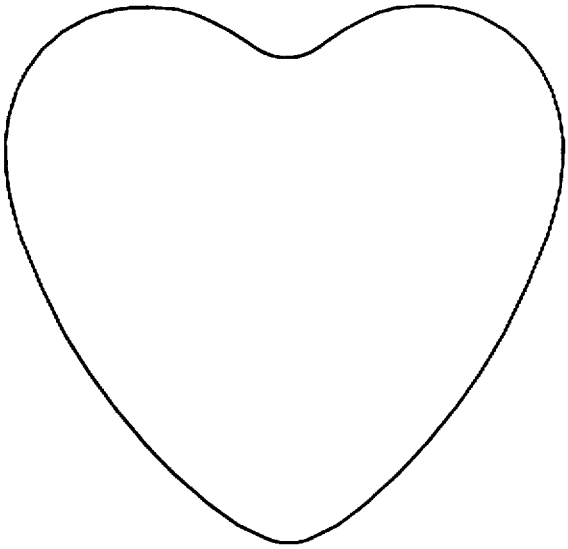
FIG. 72
FIG. 73

DIE CUT CONFETTI AND A METHOD OF MANUFACTURING

This application is a continuation-in-part U.S. patent application Ser. No. 08/639,249 filed Apr. 23, 1996 by Ardina K. Sterr and S. Clark Bason; Ser. No. 29/053,517 filed Apr. 23, 1996 by Ardina K. Sterr and S. Clark Bason; Ser. No. 29/053,622 filed Apr. 23, 1996 by Ardina K. Sterr and S. Clark Bason; and Ser. No. 29/053,516 filed Apr. 23, 1996 by Ardina K. Sterr and S. Clark Bason.

BACKGROUND OF THE INVENTION

The invention relates to confetti and an improved method for its manufacture.

Confetti has often been created from scrap paper such as small round circles from the manufacture of spiral or three hole punch notebooks or other waste material. Confetti has also been made quickly in large quantities by a traditional method of cutting several sheets of tissue paper with a straight edge paper cutter. U.S. Pat. No. 5,419,731 issued to Watkins discloses the well known use of the straight edge paper cutter to form tetragonal (squares, rectangles, etc.) pieces of confetti in large quantities, very rapidly.

The disadvantages of traditional confetti methods of manufacture are numerous. First, the use of paper scraps such as circles or irregular shapes is limited in design and ease of manufacture. As scraps are not intended to be confetti, they are typically either a standard geometric shape (circle, square, rectangle, triangle) or a completely irregular unidentifiable shape. Further, as the scraps are not the intended product, the confetti must be collected from the waste of the manufacture of other goods and packaged as waste or a byproduct. Such a method of manufacture is time consuming and inefficient for rapid mass production of a specific design of confetti.

Confetti manufactured by the use of a straight edge paper cutter reduces the amount of effort involved in collecting and packaging confetti compared to creating confetti from waste scraps. However, the use of a straight edge paper cutter to manufacture confetti limits the shape of the various possible confetti designs to geometric shapes composed of straight lines such as triangles, rectangles, squares and other tetragonal shapes.

The art of die cutting has typically been directed to manufacturing goods such as clothing, shoes, cardboard, decorative party goods and other relatively heavy stock material which is unsuitable for use as confetti. Innovations in the die cutting art are often directed to novel dies and methods of configuring the dies to reduce waste. The methods of die cutting used to manufacture clothing, shoes, and other heavy stock goods are inappropriate for manufacturing confetti because the design of the dies and the amount of force typically applied to the dies cause stacked layers of tissue paper to bind together rendering them difficult to use as confetti, and certainly useless as a method of manufacturing confetti in large quantities.

SUMMARY OF THE INVENTION

The present invention is directed to a novel method of manufacturing confetti by the use of die cutting. The present invention includes unique and fanciful die cut confetti that has unusual aerodynamic features that create visually pleasing flight patterns that have not been previously observed with traditional confetti.

BRIEF DESCRIPTION OF DRAWINGS

FIG. 11 depicts a top plan view of a piece of oak leaf shaped confetti.

FIG. 12 illustrates a bottom plan view of a piece of oak leaf shaped confetti.

FIG. 13 displays a side view of a piece of oak leaf shaped confetti.

FIG. 14 depicts a bottom left perspective view on an enlarged scale of a gang die for forming sycamore leaf shaped confetti.

FIG. 15 depicts a bottom plan view of a gang die for forming sycamore leaf shaped confetti.

FIG. 16 illustrates a front side elevational view of a gang die for forming sycamore leaf shaped confetti.

FIG. 17 displays a left side elevational view of a gang die for forming sycamore leaf shaped confetti.

FIG. 21 illustrates a top plan view of a piece of sycamore leaf shaped confetti.

FIG. 22 displays a bottom plan view of a piece of sycamore leaf shaped confetti.

FIG. 23 shows a side view of a piece of sycamore leaf shaped confetti.

FIG. 31 displays a top plan view of a piece of willow leaf shaped confetti.

FIG. 32 shows a bottom plan view of a piece of willow leaf shaped confetti.

FIG. 33 depicts a side view of a piece of willow leaf shaped confetti.

FIG. 34 displays a bottom right perspective view on an enlarged scale of a gang die for forming star shaped confetti.

FIG. 35 displays a bottom plan view of a gang die for forming star shaped confetti.

FIG. 36 shows a front side elevational view of a gang die for forming star shaped confetti.

FIG. 37 depicts a right side elevational view of a gang die for forming star shaped confetti.

FIG. 41 shows a top plan view of a piece of star shaped confetti.

FIG. 42 depicts a bottom plan view of a piece of star shaped confetti.

FIG. 43 illustrates a side view of a piece of star shaped confetti.

FIG. 44 shows a bottom right perspective view on an enlarged scale of a gang die for forming bell shaped confetti.

FIG. 45 shows a bottom plan view of a gang die for forming bell shaped confetti.

FIG. 46 depicts a front side elevational view of a gang die for forming bell shaped confetti.

FIG. 47 illustrates a right side elevational view of a gang die for forming bell shaped confetti.

FIG. 51 depicts a top plan view of a piece of bell shaped confetti.

FIG. 52 illustrates a bottom plan view of a piece of bell shaped confetti.

FIG. 53 displays a side view of a piece of bell shaped confetti.

FIG. 54 depicts a bottom right perspective view on an enlarged scale of a gang die for forming dove shaped confetti.

FIG. 55 depicts a bottom plan view of a gang die for forming dove shaped confetti.

FIG. 56 illustrates a front side elevational view of a gang die for forming dove shaped confetti.

FIG. 57 displays a right side elevational view of a gang die for forming dove shaped confetti.

FIG. 61 illustrates a top plan view of a piece of dove shaped confetti.

FIG. 62 displays a bottom plan view of a piece of dove shaped confetti.

FIG. 63 shows a side view of a piece of dove shaped confetti.

FIG. 64 illustrates a bottom right perspective view on an enlarged scale of a gang die for forming heart shaped confetti.

FIG. 65 illustrates a bottom plan view of a gang die for forming heart shaped confetti.

FIG. 66 displays a front side elevational view of a gang die for forming heart shaped confetti.

FIG. 67 shows a right side elevational view of a gang die for forming heart shaped confetti.

FIG. 71 displays a top plan view of a piece of heart shaped confetti.

FIG. 72 shows a bottom plan view of a piece of heart shaped confetti.

FIG. 73 depicts a side view of a piece of heart shaped confetti.

DETAILED DESCRIPTION OF THE DRAWINGS

Figure 1:
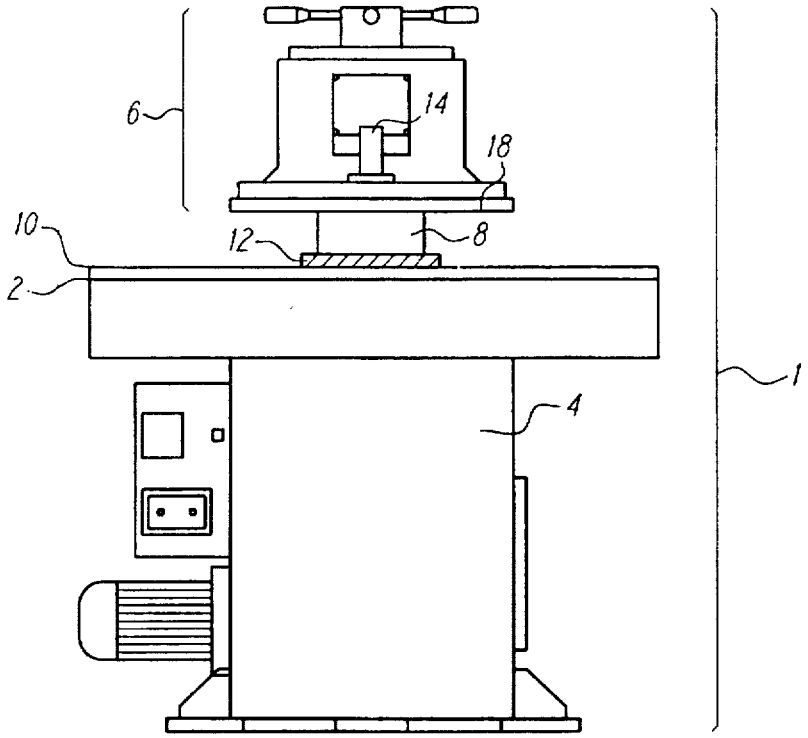
FIG. 1 shows a front elevational view of a press for practicing a method of manufacturing die cut confetti.
Figure 2:
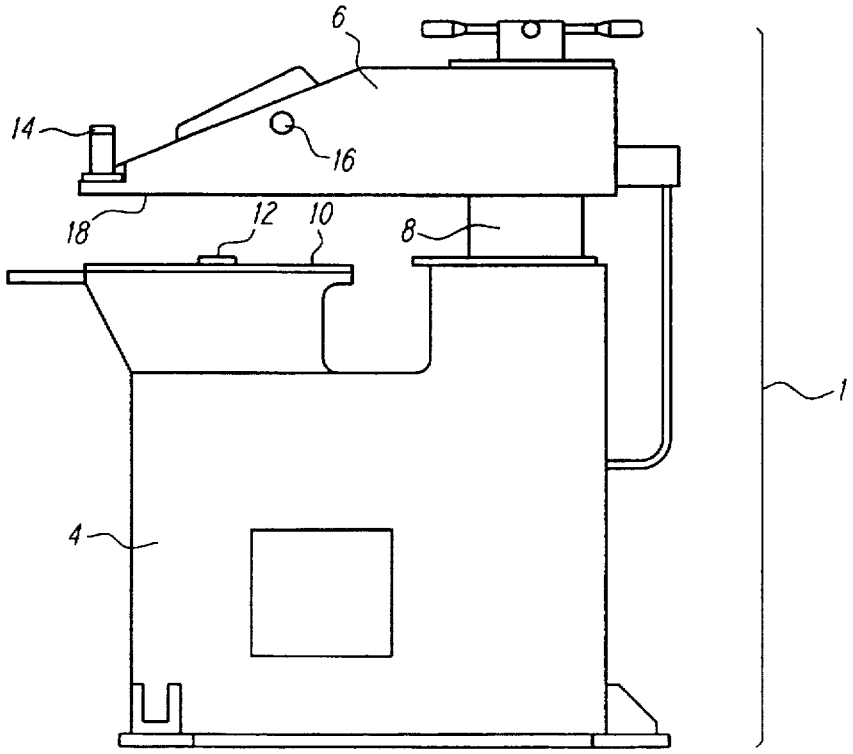
FIG. 2 depicts a side elevational view of a press for practicing a method of manufacturing die cut confetti.

FIG. 1 shows a front elevational view of a swing arm cutting press, model: Spring 19, manufactured by Meccanica ALLEVI Vigevano s.p.a. FIG. 2 shows a corresponding side elevational view of the same machine. This cutting press is an example of the type of cutting press used in the manufacture of die cut confetti in accordance with the present invention. Those skilled in the art will recognize that other die cutting machines can be used to practice the inventions described herein.

The cutting press 1 has a flat horizontal working area 2 supported by a base 4 and a moveable head 6 attached to the base 4 by arm 8. Cutting press 1 is a standard hydraulic press that is well known to those skilled in the art and is adjustable so that various amounts of force can be applied to various types of and amounts of material.

Tissue paper is milled at ten pound basis weight. Preferably, a dip dyed tissue paper such as the Madras weave available from Crystal Tissue Company, which is a relatively porous tissue, is run through flame retardant baths of ammonium phosphate ($NH_4H_2PO_4$) resulting in a twelve pound basis weight end product. Although flame retardant confetti is preferred for safety reasons, confetti can also be made of untreated tissue paper. In either case, confetti can be made from tissue paper of eight pound basis weight to eighty pound basis weight. However, ten to twelve pound basis weight is preferred. Confetti can also be made from any metallized vinyl film, preferably self extinguishing PVC film of eighty gauge. However, metallized film of sixty to one hundred and sixty gauge can be used.

The rolled stock of treated twelve pound basis weight tissue paper is cut into sheet stacks of about twenty inches by thirty inches. A stack 10 of twelve pound flame retardant tissue paper is placed on working area 2. Stack 10 of tissue paper may be of one sixteenth to one inch thick (about 30 to 480 sheets), preferably one quarter inch thick for a five to six cavity gang die, and one half inch thick for a single cavity die. Alternatively, stack 10 may be metallized film of fifteen to two hundred sheets thick, preferably one hundred sheets thick for a five to six cavity gang die and two hundred and fifty sheets thick for a single cavity die. In fact, as few as one sheet of tissue paper or metallized film can be cut by the disclosed method; however, for mass production of confetti, single sheet cutting is inefficient.

The hydraulic cutting press 1 depicted in FIGS. 1 and 2 is set to a specific setting to apply a sufficient amount of force to a die or gang die 12 which has been placed on top of tissue paper stack 10. The spring 19 has the capacity to exert a proximal force of about 21 tons. The appropriate amount of pressure to be applied is proportional to the total linear inches of die cutting edges and the thickness of material to be cut. For three to five linear inches of cutting blade, one ton of pressure will cut one quarter inches of tissue paper.

Hydraulic cutting press 1 is activated by simultaneously pushing center button 14 and one of the two side buttons 16 which actuates the hydraulic press so that hydraulic press head 6 is lowered towards the die 12 and tissue stack 10. As the hydraulic press head 6 lowers, plate 18 of head 6 pushes down on die 12 causing die 12 to cut tissue stack 10 into confetti of the desired size and shape. The hydraulic press head 6 then raises up to allow the user to remove die 12 and collect a stack of confetti. The confetti stack can then be removed from the working area for packaging or the process can be repeated without removing the confetti from the die cavity to create a thicker stack of cut confetti. This process can be repeated until all the available space of the stack 10 of tissue paper has been cut. Then, preferably the stacks of cut confetti are burst so that every piece of confetti is separated from every other piece of confetti. This allows each piece of confetti to fall individually when ejected from a propulsion device, such as a cannon or tossed into the air by hand.

Figure 3:
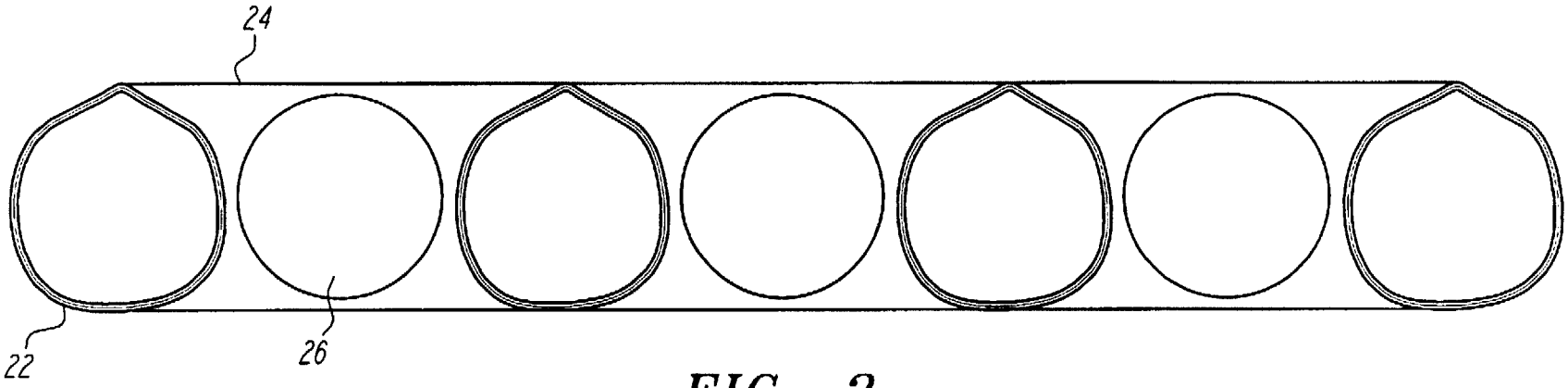
FIG. 3 illustrates a top plan view of a prior art gang die for forming petal shaped confetti.

FIG. 3 shows the prior art gang die 20 used to cut and eject light weight material which has been shaped to form petal shaped confetti. The prior art gang die 20 has individual dies 22 welded onto a metal backing 24 to form an integral closed gang die with one open cutting end. Glued onto the metal backing 24 are rubber spacers 25 (not shown) and 26. Rubber spacers 25 are within the cavity of each die. Rubber spacers 25 and 26 limit the distance the gang die can travel during a cutting motion. The rubber spacers 26 limit the amount of force and the amount of stacked material to be cut. The rubber spacers are designed to push the cut material out of the individual dies as the cutting press head raises after a cutting cycle.

However, when the prior art gang die 20 is used on tissue paper to form confetti, the individual pieces of tissue stick or fuse together and the stack of confetti does not eject out of the individual dies 22. Consequently, the operator has to physically pry the stacks of confetti out of each individual die 22. This effort can and often does damage the stacks of confetti. After removal of the stacks of confetti from the individual dies 22, the operator has to unfuse the confetti by separating each piece of tissue from the stack of confetti. As the tissue paper has fused from the edges towards the center of each confetti piece, this process can further tear or damage the confetti. Overall, the process of using the prior art die cutting process used for cutting fabric, cloth or cardboard is inefficient and wasteful in mass production of confetti.

Figure 4:
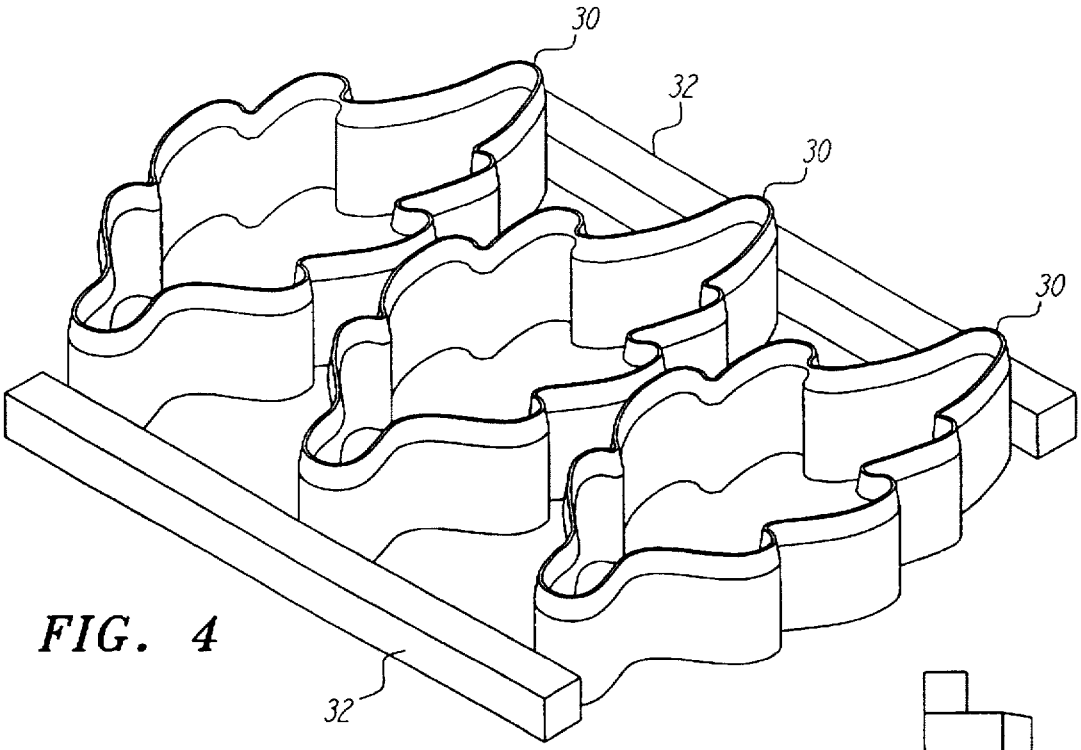
FIG. 4 shows a bottom right perspective view on an enlarged scale of a gang die for forming oak leaf shaped confetti.
Figure 5:
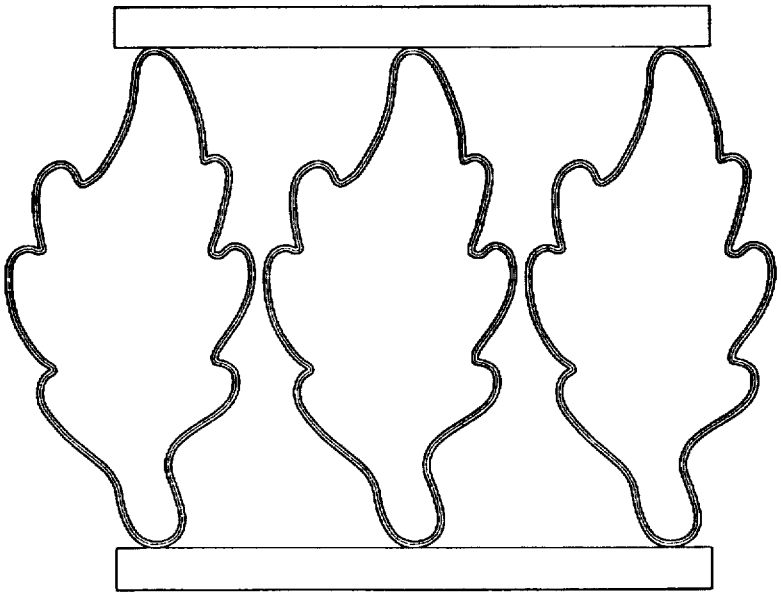
FIG. 5 shows a bottom plan view of a gang die for forming oak leaf confetti.
Figure 7:
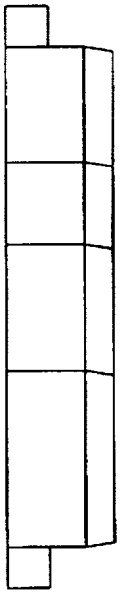
FIG. 7 illustrates a right side elevational view of a gang die for forming oak leaf confetti.
Figure 6:
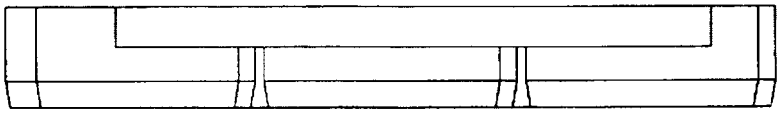
FIG. 6 depicts a front side elevational view of a gang die for forming oak leaf confetti.
Figure 8:
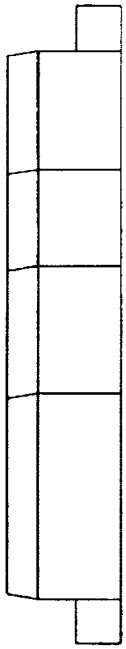
FIG. 8 depicts a left side elevational view of a gang die for forming oak leaf confetti.
Figure 9:
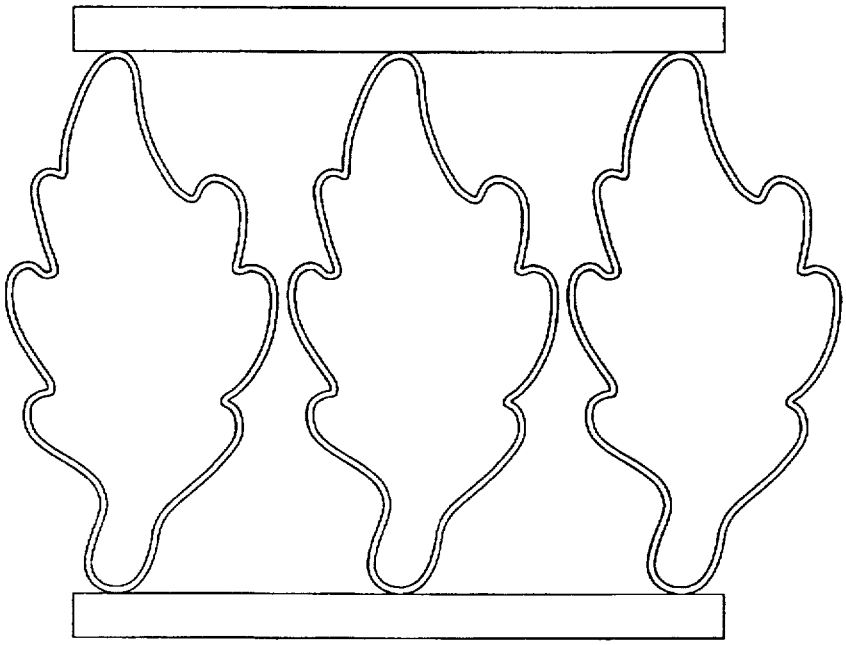
FIG. 9 displays a top plan view of a gang die for forming oak leaf confetti.
Figure 10:
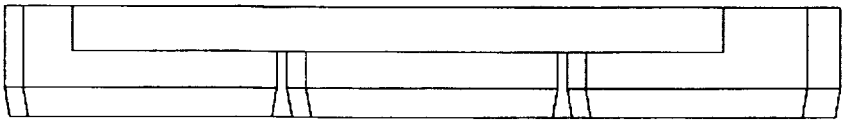
FIG. 10 displays a rear side elevational view of a gang die for forming oak leaf shaped confetti.

FIG. 4 shows a bottom right perspective view of the ornamental oak leaf gang die; FIG. 5 shows a bottom plan view; FIG. 6 shows a front side elevational view; FIG. 7 shows a right side elevational view; and FIG. 8 shows a left side elevational view; FIG. 9 shows a top plan view and FIG. 10 shows a rear side elevational view. As shown in FIG. 4, individual dies 30 are welded onto metal pull bars 32 which held the gang die together. The open ended construction of the gang die is preferred over the closed ended construction of the prior art gang die (FIG. 3) as it allows the confetti to be easily removed from the individual dies without damaging the stacks of confetti. The three cavity oak leaf gang die has seventeen total linear inches of cutting blade.

Preferably the dies used are forged clearance dies with a high polished finish and an extended cutting edge. The forged clear dies have a blade height of one and one quarter inches and cutting edge height of approximately one eighth of an inch. As those of skilled in the art of die cutting will readily recognize the cavity of the forged clearance die widens along the height of the blade.

Alternatively, flexible steel dies with a waxed finish can be used. The flexible steel die has a cavity of about one and one quarter inches in height and a cutting edge height of thickness of about one sixteenth inch. Additionally, for either type of die breakaway chisel arms may be used to release pressure and allow thicker stacks of paper to be cut. It is also preferred to have pressure relief notches cut out of the top edge of the die to allow air to escape as the confetti fills the die cavity.

It is important to keep gang dies sharp to maximize their cutting effectiveness. If too much force is applied to the dies, the edges of the stacks of tissue confetti may fuse. However, unlike the prior art close ended gang die, fusing with an open die is limited to the edges of the confetti, which is much easier to burst as opposed to tearing each individual piece of confetti off a fused stack. In the case of metallized vinyl confetti, the confetti will crinkle or warp when too much force is applied. To maximize the quality of the shapes of die cut confetti and minimize the tissue scraps that the individual dies on the gang die should be approximately one quarter inch apart. Although individual dies can be used to create the confetti disclosed herein, for mass production gang dies are preferred.

FIG. 11 illustrates a top plan view of a piece of ornamental oak shaped confetti 34 formed by an oak shaped die 30. FIG. 12 shows a bottom plan view of a piece of ornamental oak shaped confetti. FIG. 13 shows a side view of a piece of ornamental oak shaped confetti. Those skilled in the art will recognize that, although the individual pieces of oak shaped confetti have a thickness, which displays detail, to adequately illustrate the relative proportions of the dimensions of the oak leaf confetti the details of the side view cannot be shown.

As shown in FIG. 11 the oak leaf shaped confetti has crenated edges 27 and 29, with crenatures 27*a*, 27*b*, 27*c* and 29*a*, 29*b*, 29*c*, on the respective crenated edges. The oak leaf shaped confetti also has a confetti stem 31 and a confetti leaf tip 33. The oak leaf shaped confetti is approximately six inches in length from the end of stem 31 to the end of confetti leaf tip 33. The oak leaf shaped confetti is about three inches wide at its widest point between the crenatures 29*b* and 27*b* of crenated edges 29 and 27 and tapers to two and one half inches to two and one quarter inches to between crenatures 27*a* and 29*a* and 27*c* and 29*c*.

When thrown into the air, oak leaf shaped confetti will slowly descend to the ground in tumbling, sweeping, and rocking motions. The oak leaf shaped confetti may sweep downward with the confetti leaf tip 33 or confetti stem 31 leading the confetti in a sweeping dive. Also, the confetti may rock and sway back and forth with crenated edges 27 and 29 rising to the apex of the swinging motion. The confetti may also tumble or somersault as it descends with the crenated edges flipping around a longitudinal axis between confetti leaf tip 33 and confetti stem 31.

Figure 18:
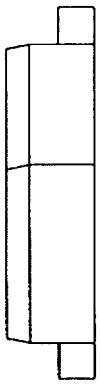
FIG. 18 depicts a right side elevational view of a gang die for forming sycamore leaf shaped confetti.
Figure 19:
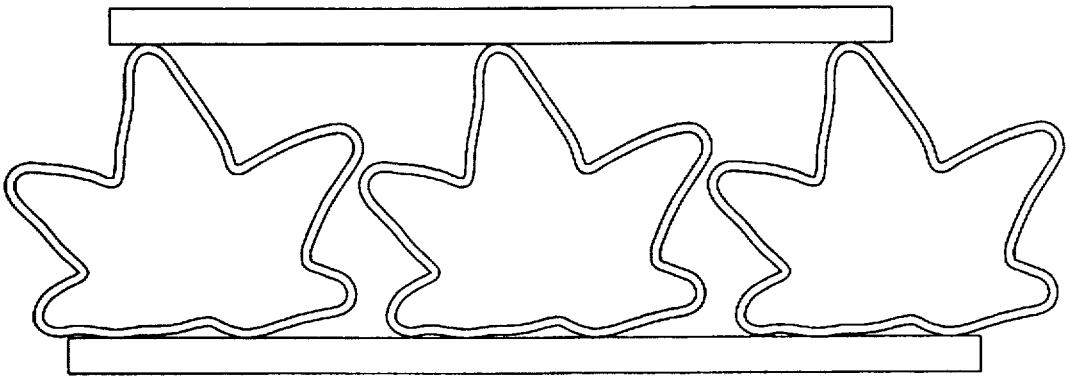
FIG. 19 shows a top plan view of a gang die for forming sycamore leaf shaped confetti.
Figure 20:
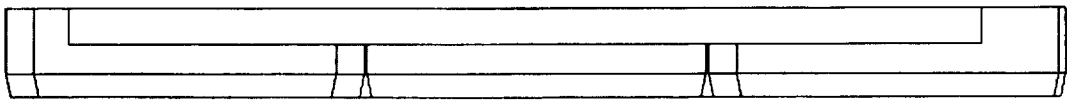
FIG. 20 shows a rear side elevational view of a gang die for forming sycamore leaf shaped confetti.

FIG. 14 shows a bottom left perspective view of an ornamental gang die 36 for making sycamore leaf shaped confetti. Individual sycamore leaf shaped dies 38 are welded onto metal pull bars 32 which hold the gang die together. FIG. 15 shows a bottom plan view of the ornamental sycamore leaf shaped gang die; FIG. 16 shows a front side elevational view; FIG. 17 shows a right side elevational view; FIG. 18 shows a left side elevational view and FIG. 19 shows a top plan view; FIG. 20 shows a rear side elevational view. The three cavity sycamore leaf gang die has seventeen and one half and one half linear inches of cutting blade per cavity.

FIG. 21 illustrates the top plan view of a piece of ornamental sycamore leaf shaped confetti formed by a sycamore leaf shaped die 38. FIG. 22 shows a bottom plan view of a piece of ornamental sycamore leaf shaped confetti. FIG. 23 shows side view of a piece of ornamental sycamore leaf shaped confetti. Those skilled in the art will recognize that, although the individual pieces of sycamore leaf shaped confetti have a thickness which displays detail, to adequately illustrate the relative proportions of the dimensions of the sycamore leaf shaped confetti, the details of the side view cannot be shown.

The sycamore leaf shaped confetti shown in FIG. 21 is palmately lobed in appearance. The sycamore leaf shaped confetti has five confetti lobes 35*a*, 35*b*, 35*c*, 35*d* and 35*e* with a confetti leaf base 37. The sycamore leaf shaped confetti is about three and three quarters inches long from the confetti leaf base 37 to the confetti lobe 35*c* about four and one half inches wide between confetti lobes 35*b* and 37*d*, and about four inches wide between confetti lobes 37*a* and 37*e*.

When the sycamore leaf shaped confetti is thrown in the air it slowly descends in floating, hovering and rocking motions with little or no flipping motion. Typically, as the sycamore leaf shaped confetti falls to the ground, it rocks back and forth in a horizontal motion relative to the ground.

Figure 24:
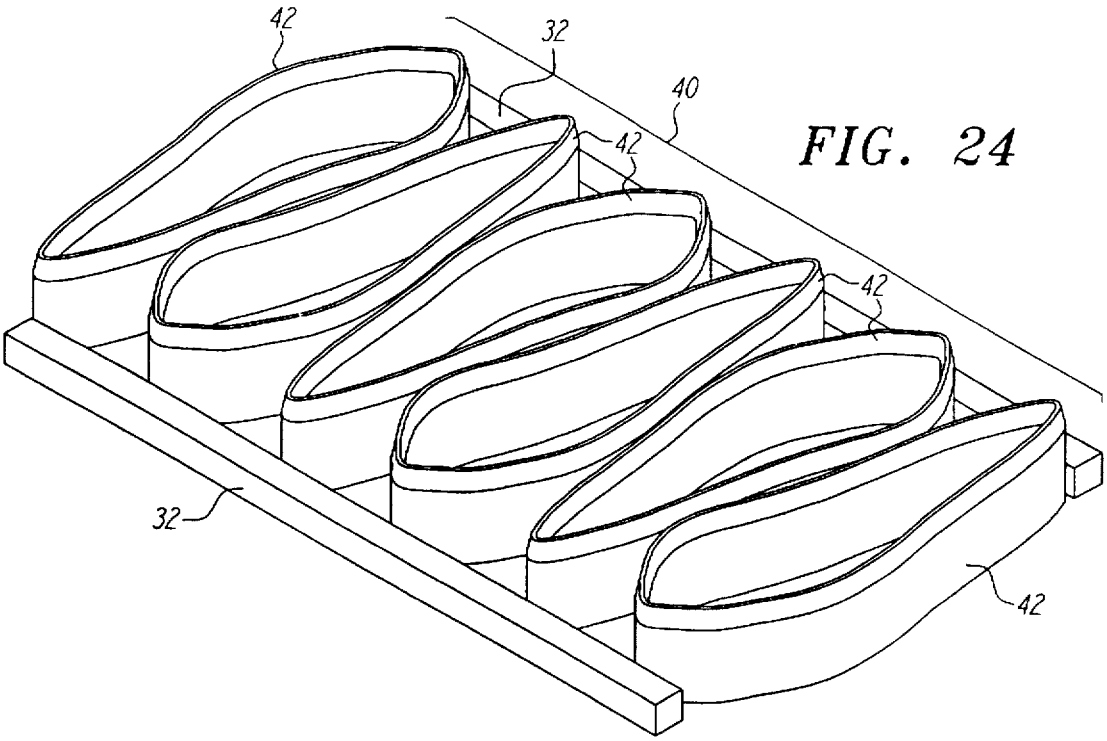
FIG. 24 illustrates a bottom right perspective view on an enlarged scale of a gang die for forming willow leaf shaped confetti.
Figure 25:
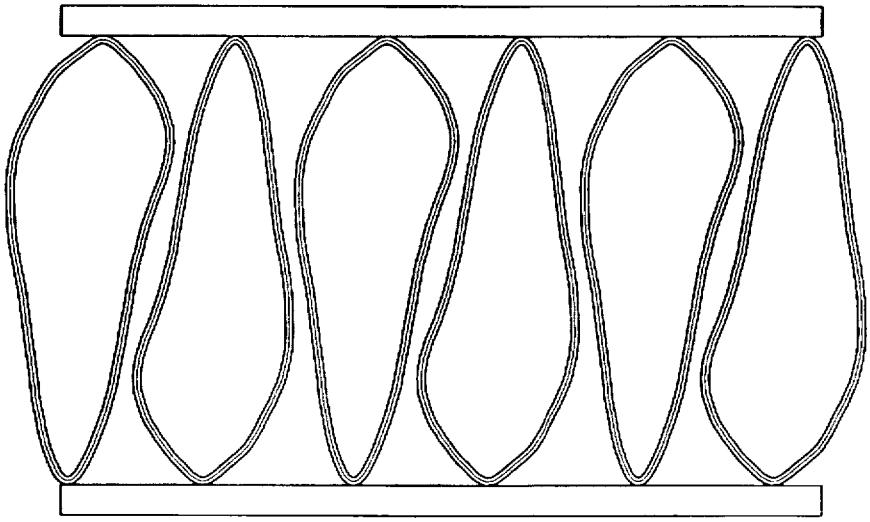
FIG. 25 illustrates a bottom plan view of a gang die for forming willow leaf shaped confetti.
Figure 27:
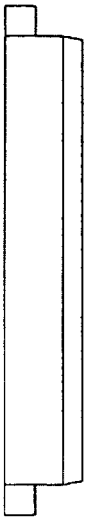
FIG. 27 shows a right side elevational view of a gang die for forming willow leaf shaped confetti.
Figure 26:
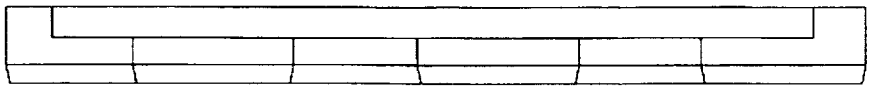
FIG. 26 displays a front side elevational view of a gang die for forming willow leaf shaped confetti.
Figure 28:
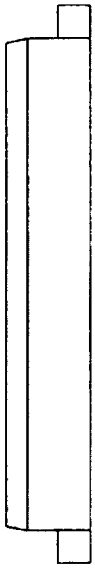
FIG. 28 depicts a left side elevational view of a gang die for forming willow leaf shaped confetti.
Figure 29:
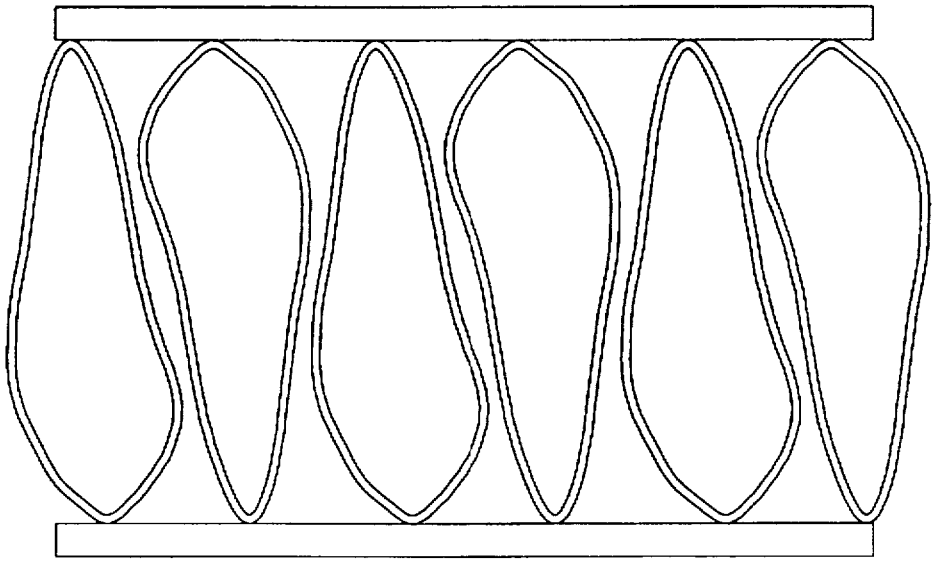
FIG. 29 depicts a top plan view of a gang die for forming willow leaf shaped confetti.
Figure 30:
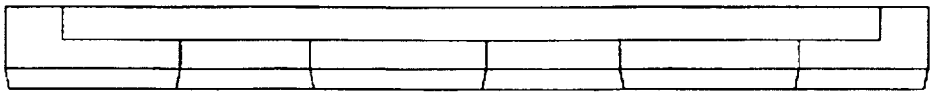
FIG. 30 depicts a rear side elevational view of a gang die for forming willow leaf shaped confetti.

FIG. 24 shows a bottom right perspective view of an ornamental gang die 40 for making willow leaf shaped confetti. Individual willow leaf shaped dies 42 are welded onto metal pull bars 32 which hold the gang die together. FIG. 25 shows a bottom plan view of the ornamental willow leaf shaped gang die; FIG. 26 shows a front side elevational view; FIG. 27 shows a right side elevational view; FIG. 28 shows a left side elevational view and FIG. 29 shows a top plan view, and FIG. 30 shows a rear elevational view. The six cavity willow leaf gang die has ten and one half linear inches of cutting blade per cavity.

FIG. 31 illustrates the top plan view of a piece of ornamental willow leaf shaped confetti formed by willow leaf shaped die 42. FIG. 32 shows a bottom plan view of a piece of ornamental willow leaf shaped confetti. FIG. 33 shows side view of a piece of ornamental willow leaf shaped confetti. Those skilled in the art will recognize that, although the individual pieces of willow leaf shaped confetti have a thickness which displays detail, to adequately illustrate the relative proportions of the dimensions of the willow leaf shaped confetti, the details of the side view cannot be shown.

As depicted in FIG. 31 the willow leaf shaped confetti is lanceolate in shape with a confetti leaf tip 33, a confetti leaf base 37 and confetti leaf sides 39. The willow leaf shaped confetti is about four and one half inches in length from confetti leaf tip 33 to confetti leaf base 37, and about one and one half inches in width at its widest point between confetti leaf sides 39.

When thrown into the air willow leaf shaped confetti slowly descends to the ground in flipping and sweeping motions. Typically, as the willow shaped confetti falls to the ground, the leaf edges 39 of the confetti slowly flip or spin around a longitudinal axis between confetti leaf tip 33 and confetti leaf base 37. Occasionally, the willow leaf shaped confetti may also dart or swoop as it descends to the ground with confetti leaf tip 33 or confetti leaf base 37 leading the descent of swooping or darting motion.

Figure 38:
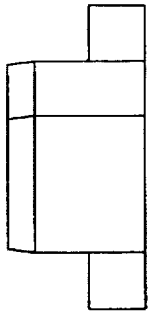
FIG. 38 depicts a left side elevational view of a gang die for forming star shaped confetti.
Figure 39:
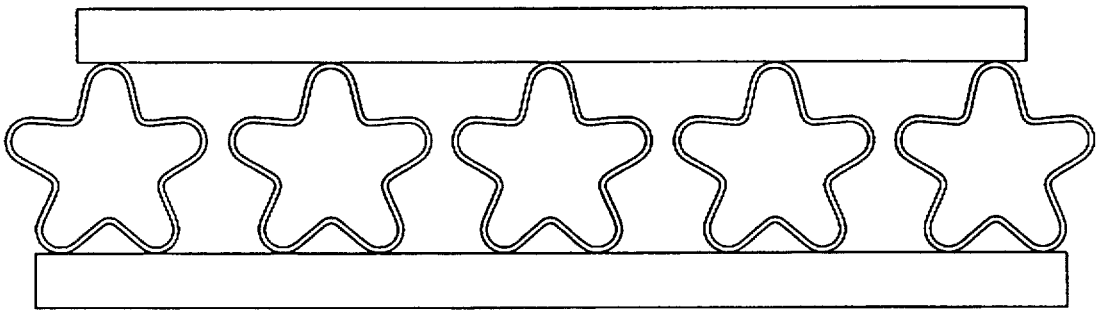
FIG. 39 illustrates a top plan view of a gang die for forming star shaped confetti.
Figure 40:
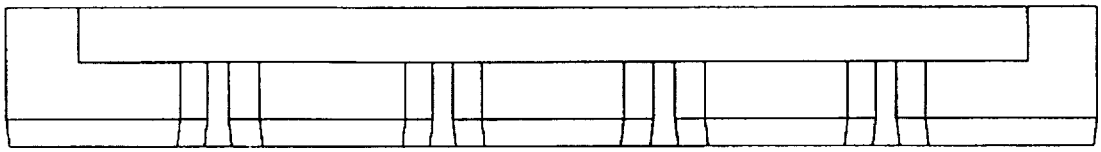
FIG. 40 illustrates a rear side elevational view of a gang die for forming star shaped confetti.

FIG. 34 shows a bottom right perspective view of an ornamental gang die 44 for making star shaped confetti. Individual star shaped dies 46 are welded onto metal pull bars 32 which hold the gang die together. FIG. 35 shows a bottom plan view of the ornamental star shaped gang die; FIG. 36 shows a front side elevational view; FIG. 37 shows a right side elevational view; FIG. 38 shows a left side elevational view and FIG. 39 shows a top plan view, and FIG. 40 shows a rear side elevational view. The five cavity star gang die has seven linear inches of cutting blade per cavity.

FIG. 41 illustrates the top plan view of a piece of ornamental star shaped confetti formed by star shaped die 46. FIG. 42 shows a bottom plan view of a piece of ornamental star shaped confetti. FIG. 43 shows side view of a piece of ornamental star shaped confetti. Those skilled in the art will recognize that, although the individual pieces of star shaped confetti have a thickness which displays detail, to adequately illustrate the relative proportions of the dimensions of the star shaped confetti, the details of the side view cannot be shown.

As shown in FIG. 41, the star shaped confetti is in the form of a five pointed star, although many other star shapes are possible. The star shaped confetti has five star points 41*a*, 41*b*, 41*c*, 41*d* and 41*e*. The distance between 41*b* and 41*e* is about two inches or more precisely five millimeters, the distance between 41*a* and 41*d* or 41*c* is about one and seven eighths inches or more precisely four and seven tenths centimeters.

When the star shaped confetti is thrown into the air, it slowly descends to the ground in floating, tumbling and rocking motions. Typically, the star shaped confetti will tumble or flip in a circular fashion and rock back and forth between tumbles or flips as it floats to the ground.

Figure 48:
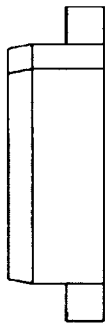
FIG. 48 depicts a left side elevational view of a gang die for forming bell shaped confetti.
Figure 49:
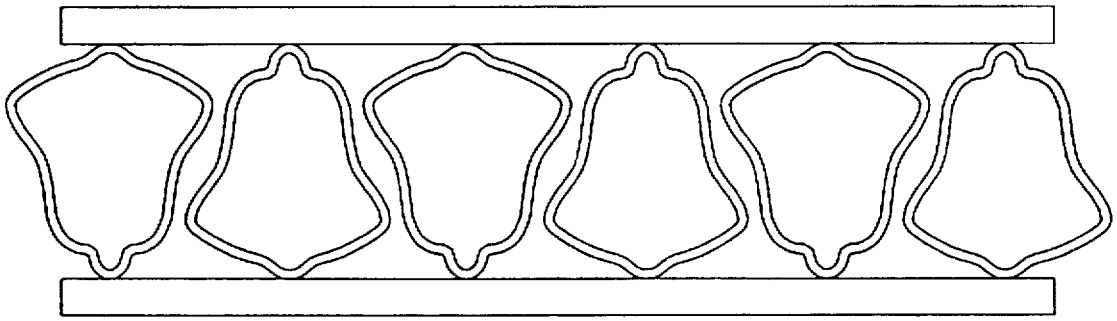
FIG. 49 displays a top plan view of a gang die for forming bell shaped confetti.
Figure 50:
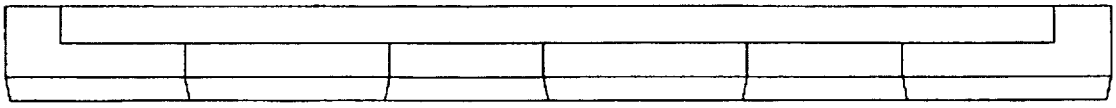
FIG. 50 displays a rear side elevational view of a gang die for forming bell shaped confetti.

FIG. 44 shows a bottom right perspective view of an ornamental gang die 48 for making bell shaped confetti. Individual bell shaped dies 50 are welded onto metal pull bars 32 which hold the gang die together. FIG. 45 shows a bottom plan view of the ornamental bell shaped gang die; FIG. 46 shows a front side elevational view; FIG. 47 shows a right side elevational view; FIG. 48 shows a left side elevational view and FIG. 49 shows a top plan view, and FIG. 50 shows a rear side elevational view. The six cavity bell gang die has five and three quarters linear inches of cutting blades per cavity.

FIG. 51 illustrates the top plan view of a piece of ornamental bell shaped confetti formed by bell shaped die 50. FIG. 52 shows a bottom plan view of a piece of ornamental bell shaped confetti. FIG. 53 shows side view of a piece of ornamental bell shaped confetti. Those skilled in the art will recognize that, although the individual pieces of bell shaped confetti have a thickness which displays detail, to adequately illustrate the relative proportions of the dimensions of the bell shaped confetti, the details of the side view cannot be shown.

FIG. 45 shows the bell shaped confetti which has a top 43, a base 45, and a clapper 47. The distance from the tip of the top 43 to the end of the clapper 47 is about two inches or more precisely four and eight tenths centimeters. The distance across the base 45 at its widest point is one and five eighths inches and the distance across the top 43 at its widest point is about one inch.

When the bell shaped confetti is thrown into the air, it slowly descends to the ground in floating, tumbling and rocking motions. Typically, the bell shaped confetti will tumble or flip in a circular fashion and rock back and forth between tumbles or flips as it floats to the ground.

Figure 58:
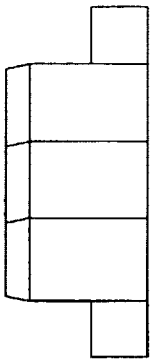
FIG. 58 depicts a left side elevational view of a gang die for forming dove shaped confetti.
Figure 59:
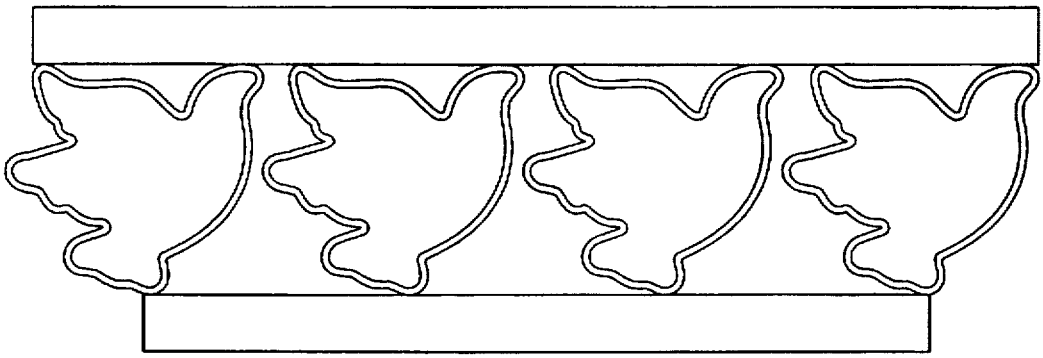
FIG. 59 shows a top plan view of a gang die for forming dove shaped confetti.
Figure 60:
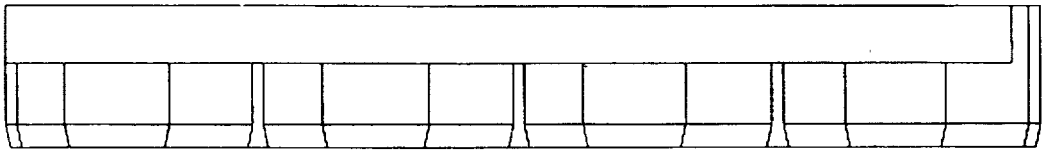
FIG. 60 shows a rear side elevational view of a gang die for forming dove shaped confetti.

FIG. 54 shows a bottom right perspective view of an ornamental gang die 52 for making dove shaped confetti. Individual dove shaped dies 54 are welded onto metal pull bars 32 which hold the gang die together. FIG. 55 shows a bottom plan view of the ornamental dove shaped gang die; FIG. 56 shows a front side elevational view; FIG. 57 shows a right side elevational view; FIG. 58 shows a left side elevational view and FIG. 59 shows a top plan view and FIG. 60 shows a rear side elevational view. The four cavity dove gang die has seven and one half linear inches of cutting blade per cavity.

FIG. 61 illustrates the top view of a piece of ornamental dove shaped confetti formed by dove shaped die 51. FIG. 62 shows a bottom plan view of a piece of ornamental dove shaped confetti. FIG. 63 shows side view of a piece of ornamental dove shaped confetti. Those skilled in the art will recognize that, although the individual pieces of confetti have a thickness which displays detail, to adequately illustrate the relative proportions of the dimensions of the dove shaped confetti, the details of the side view cannot be shown.

FIG. 61 shows a piece of the dove shaped confetti which has a head 49, a pair of wings 51*a* and 51*b* and a tail 53 and a belly 55. The distance from the end of the head 49 to the tip of the tail 53 is two inches and the distance from the belly 55 to the tip of wing 51 is one and three quarters inches.

When the dove shaped confetti is thrown into the air, it slowly descends to the ground in floating, tumbling and rocking motions. Typically, the dove shaped confetti will tumble or flip in a circular fashion and rock back and forth between tumbles or flips as it floats to the ground.

Figure 68:
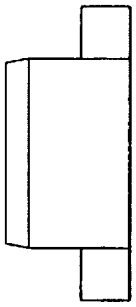
FIG. 68 depicts a left side elevational view of a gang die for forming heart shaped confetti.
Figure 69:
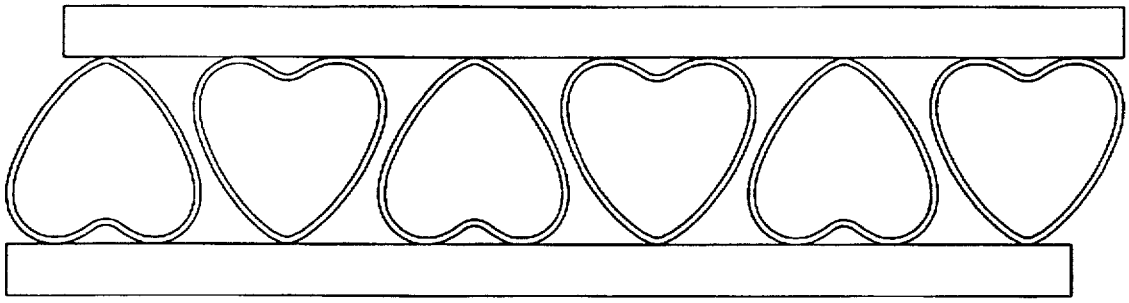
FIG. 69 depicts a top plan view of a gang die for forming heart shaped confetti.
Figure 70:
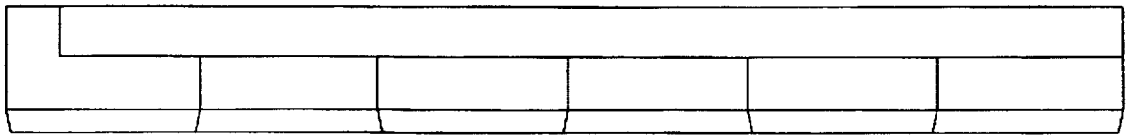
FIG. 70 depicts a rear side elevational view of a gang die for forming heart shaped confetti.

FIG. 64 shows a bottom right perspective view of an ornamental gang die 56 for making heart shaped confetti. Individual heart shaped dies 58 are welded onto metal pull bars 32 which hold the gang die together. FIG. 65 shows a bottom plan view of the ornamental heart shaped gang die; FIG. 66 shows a front side elevational view; FIG. 67 shows a right side elevational view; FIG. 68 shows a left side elevational view; FIG. 69 shows a top plan view and FIG. 70 shows a rear side elevational view. The six cavity heart gang die has six and one half linear inches of cutting blade per cavity.

FIG. 71 illustrates the top view of a piece of ornamental heart shaped confetti formed by heart shaped gang die 58. FIG. 72 shows a bottom plan view of a piece of ornamental heart shaped confetti. FIG. 73 shows side view of a piece of ornamental heart shaped confetti. Those skilled in the art will recognize that, although the individual pieces of heart shaped confetti have a thickness which displays detail, to adequately illustrate the relative proportions of the dimensions of the heart shaped confetti, the details of the side view cannot be shown.

FIG. 71 shows a piece of heart shaped confetti which has a bottom end 57 and a pair of confetti lobes 59*a* and 59*b*. The distance across the widest part of the lobes is one and three quarters inches and the distance from the bottom end to the nadir between lobes 59*a* and 59*b* is about one and five eighths inches.

When the heart shaped confetti is thrown into the air, it slowly descends to the ground in floating, tumbling and rocking motions. Typically, the heart shaped confetti will tumble or flip in a circular fashion and rock back and forth between tumbles or flips as it floats to the ground.

While various apparatus and methods of making and using die cut confetti have been described in order to make the invention known to those skilled in the art, it should be readily apparent that many more modifications of the apparatus and methods disclosed are possible without departing from the inventive concepts contained herein. The foregoing description, therefore, should be taken as illustrative and not limiting in any sense.

What is claimed:

1. A method of manufacturing a stack of confetti comprising:

(a) stacking a plurality of sheets of lightweight sheet material into a first stack;

(b) placing an open ended die onto said first stack;

(c) applying sufficient force to said die to cut said first stack into a second stack of lightweight material having the shape of the cavity of said die without fusing said sheets of lightweight material to each other.

2. The method of claim 1 wherein said lightweight material is selected from the group comprising tissue paper and vinyl film.

3. The method of claim 1 further comprising repeatedly cutting said first stack to create a plurality of second stacks.

4. The method of claim 1 wherein said die has a cutting surface measured in linear inches and wherein said force is applied in the proportion of one ton per three linear inches.

5. The method of claim 1 wherein said stack of tissue paper is at least one sixteenth inches high.

6. The method of claim 1 wherein the shape of the cavity of said die is a leaf.

7. A method of manufacturing a stack of confetti comprising:

(a) stacking a plurality of sheets of lightweight sheet material into a stack at least one sixteenth inches high;

(b) placing onto said first stack an open ended gang die having a plurality of cavities with a cutting edge measured in linear inches;

(c) applying at least one ton of pressure for every three linear inches of cutting edge to said gang die to cut said first stack of lightweight sheet material into a plurality of second stacks of lightweight sheet material in the shape of the cavities of said gang die;

(d) bursting each second stack of lightweight material to separate said sheets of lightweight material from each other.

8. The method of claim 1 wherein said lightweight material is selected from the group comprising tissue paper and vinyl film.

9. The method of claim 1 wherein said gang die has a plurality of leaf shaped cavities.

10. The method of claim 1 wherein said gang die has a plurality of dove shaped cavities.

11. The method of claim 1 wherein said gang die has a plurality of bell shaped cavities.

12. The method of claim 1 wherein said gang die has a plurality of star shaped cavities.

13. A method of manufacturing a stack of confetti comprising:

(a) stacking a plurality of sheets of light weight sheet material into a first stack;

(b) placing an open ended gang die having a plurality of cavities onto said first stack;

(c) applying sufficient force to said gang die to cut said first stack into a plurality of second stacks having the shape of the cavities of said die without fusing said sheets of lightweight material to each other;

(d) bursting each second stack of lightweight material to separate said sheets of lightweight material.

14. The method of claim 13 wherein said lightweight material is selected from the group comprising tissue paper and vinyl film.

15. The method of claim 7 wherein each cavity of said gang die has a leaf shape and at least ten and one half linear inches of cutting blade.

16. The method of claim 7 wherein each cavity of said gang die has a star shape and at least seven linear inches of cutting blade.

17. The method of claim 7 wherein each cavity of said gang die has a bell shape and at least five and three quarters inches of linear cutting blade.

18. The method of claim 7 wherein each cavity of said gang die has a star shape and at least seven inches of linear cutting blade.

19. The method of claim 7 wherein each cavity of said gang die has a dove shape and at least seven and a half linear inches of cutting blade.

20. The method of claim 7 wherein each cavity of said gang die has a heart shape and at least six and one half linear inches of cutting blade.

* * * * *

UNITED STATES PATENT AND TRADEMARK OFFICE

CERTIFICATE OF CORRECTION

PATENT NO. : 5,797,304

DATED : August 25, 1998

INVENTOR(S) : Sterr et al.

It is certified that error appears in the above-identified patent and that said Letters Patent is hereby corrected as shown below:

In claim 8 (Col. 10, line 51), delete "1" and insert therefor -- 7 --.

In claim 9 (Col. 10, line 54), delete "1" and insert therefor -- 7 --.

In claim 10 (Col. 10, line 56), delete "1" and insert therefor -- 7 --.

In claim 11 (Col. 10, line 58), delete "1" and insert therefor -- 7 --.

In claim 12 (Col. 10, line 60), delete "1" and insert therefor -- 7 --.

In claim 15 (Col. 11, line 10), delete "7" and insert therefor -- 13 --.

In claim 16 (Col. 11, line 13), delete "7" and insert therefor -- 13 --.

In claim 17 (Col. 12, line 1), delete "7" and insert therefor -- 13 --.

UNITED STATES PATENT AND TRADEMARK OFFICE

CERTIFICATE OF CORRECTION

PATENT NO. : 5,797,304

DATED : August 25, 1998

INVENTOR(S) : Sterr et al.

It is certified that error appears in the above-identified patent and that said Letters Patent is hereby corrected as shown below:

In claim 18 (Col. 12, line 4), delete "7" and insert therefor -- 13 --.

In claim 19 (Col. 12, line 7), delete "7" and insert therefor -- 13 --.

In claim 20 (Col. 12, line 10), delete "7" and insert therefor -- 13 --.

Signed and Sealed this

Eleventh Day of July, 2000

*Attest:*

Q. TODD DICKINSON

*Attesting Officer*

*Director of Patents and Trademarks*